United States Patent [19]

Forrest

[11] Patent Number: 4,761,206

[45] Date of Patent: Aug. 2, 1988

[54] METHOD FOR PRODUCING LARGE REINFORCED SEAMLESS CASINGS AND THE PRODUCT OBTAINED THEREFROM

[76] Inventor: Norman Forrest, 6434 Woodthrush Ct., Palm Beach Gardens, Fla. 33410

[21] Appl. No.: 15,644

[22] Filed: Feb. 17, 1987

[51] Int. Cl.[4] ..... C25D 1/02

[52] U.S. Cl. ..... 204/9

[58] Field of Search ..... 204/4, 9, 16

[56] References Cited

U.S. PATENT DOCUMENTS 3,505,177 4/1970 Chester ..... 204/9

3,763,001 10/1973 Withers ..... 204/9

*Primary Examiner*—T. M. Tufariello

*Attorney, Agent, or Firm*—Lawrence Rosen

[57] ABSTRACT

A method of forming a high tensile strength, reinforced, seamless, large cylindrical casing wherein a metal such as nickel is electrodeposited in conjunction with reinforcing materials such as carbon fibers to form a matrix on the outer surface of a rubber layer, the surface of which has been rendered electroconductive, deposited on a mandrel but separated therefrom by a separating material, such as wax, which will permit ready separation of the finished casing product from the mandrel when by heating the latter until the separating material melts or liquefies.

16 Claims, 1 Drawing Sheet

METHOD FOR PRODUCING LARGE REINFORCED SEAMLESS CASINGS AND THE PRODUCT OBTAINED THEREFROM

FIELD OF THE INVENTION

The invention relates to an improved method for manufacturing large reinforced, seamless casings such as those used in rocket, missile and spacecraft constructions, and especially to booster rocket casings.

BACKGROUND AND PRIOR ART

When the Challenger space shuttle exploded in January, 1986 subsequent investigations, as reported in *The New York Times* of Dec. 8, 1986, page B15, indicated that the root of the problem was the booster rockets four large steel-walled segments. These 27 foot long segments had thick rubber insulation between casing and fuel to keep the searing heat of burning propellant from melting the walls. The temperature of this heat can reach upwards of 5800° F. Specially prepared rubbers are vulcanized to the inside of the metal casing utilizing pressure and heat to ensure the necessary bonding. However, no insulation covered or could cover the precise areas where the segments fit together. Instead, they were locked together by a tongue-and-groove joint and additionally protected from the leakage of hot gases by a pair of rubbery O-shaped seals or rings.

Unfortunately, pressures in the rocket forced the joint open which allowed hot gases and flames to contact the O rings. As further reported, an additional problem resulted from the exceptionally cold weather on the morning of the launch, which kept the O rings from expanding properly and thereby allowed flames to leak past them outside the rocket and disastrously caused the explosion in the huge adjacent fuel tank full of liquid hydrogen.

It has been recognized that segmenting of the rocket casing makes it difficult to protect the joints between the sections from the searing rocket flames. Nevertheless, segmented rocket casings have been used worldwise because they can be manufactured far from launch and shipped in pieces to launching sites where they are assembled. Monolithic rocket casings had been proposed heretofore, but it was believed that by casting giant rockets in sections the segments are much easier to ship and easier to inspect than monolithic casings.

A monolithic steel rocket casing involving welding seams and joints was designed by the Aerojet Solid Propulsion Company in accordance with a report in The New York Times of Dec. 7, 1986. The report indicates that Aerojet, one of four bidders for a U.S. government contract, faulted the rubbery seals of segmented rockets while the other three bidders presented segmented rocket casings.

Although at one time there was some concern that the fuel in monolithic rocket casings would be difficult to inspect for bubbles and cracks and might therefore contain hidden paths allowing a dangerous quick burn toward the metal casing, improved techniques and expertise have essentially eliminated these doubts.

Another concern about the monolithic casings heretofore available arose because the welds cannot be trusted under the elevated temperatures and pressures encountered during use, as evidenced by several failures when the weld ruptured. Moreover, at present there is no reliable inspection method for fail safe welds.

It would be desirable therefore to eliminate the joints and the concomitant need for O rings or similar gaskets as well as the need for welding in the manufacture of metallic rocket casings. It would also be desirable to have available a method for readily manufacturing seamless, monolithic rocket casings in the general area of launching or sufficiently close to avoid any possible transportation problems. Moreover, it would be desirable to have available a method which can readily be employed for producing a variety of single piece (i.e., no seams or joints) casings essentially on site, obviating the recognized multiple handling and transportation problems.

Referring again to rocket casings specifically, it appears that there are two possible methods of manufacture. The one discussed in detail above involves casting and forging steel with subsequent heat treatment and quenching steps in order to obtain the desired physical characteristics. An attempt to cast rocket casings in one piece, e.g., 108 feet by 12 feet in diameter, is a monumental undertaking and that is why small segments are prepared and either joined together as described above, or welded together.

The other method available at the present time is to filament-wind graphite or glass fibers coated with epoxy resin around pre-formed metallic cylinders. However, this method has been found to be too limited in use for fabrication of large size casings which would be difficult to maneuver in all directions. In addition, one of the objects of the present invention is to prepare relatively thin-walled, large casings with high tensile strengths rather than thick-walled casings which would obviously have size limitations.

It will be recognized that the manufacture of fail safe booster rocket casings is of the utmost importance for space exploration and space defense programs. As evidenced by recent failures, there is a need for superior casings, and especially for casings that do not have the potential weak link joint seals required when assembling casing segments that have been separately manufactured, filled with rocket fuel and then transported to the launch site. As will be further understood, merely to substitute monolithic steel casings for the present steel segments poses formidable problems because of the enormous weights involved. Thus, manufacturing operations for previously proposed monolithic casings are certain to be more complicated and more expensive than those for casing segments. In addition, transportation and hoisting problems would be enormous. Consequently any redesign of booster rocket casings must not only avoid the present problems with segmented casings but also the obvious manufacturing problems posed by producing seamless casings that must combine relatively great height with great strength.

BRIEF SUMMARY OF THE INVENTION

In accordance with the present invention a method has been developed for the manufacture of large cylindrical casings, such as rocket casings, that are seamless, non-segmented. The casings of the inventive method can be made in extraordinarily large lengths and diameters as well as being structurally strong. The latter is particularly important when the casings are used in rockets, since the casings must be able to withstand the enormous internal forces generated by expanding gases following fuel ignition.

The method of the invention, in general, involves the use of a hollow mandrel rotating in an electroplating bath wherein a non-steel metal is deposited on the outer surface of the hollow mandrel. For most purposes, the hollow mandrel is made having the same length of the finished casing, but with a somewhat small outer diameter to be compensated by for the thickness of the electroformed layer as well as the thickness of intermediate layers. Means are provided for rotating the mandrel in a horizontal position in the electroplating bath and for preventing deposition of the electroplating metal inside the mandrel. Metals that can be electroplated on to the mandrel include nickel, copper, chromium, tin, lead, gold, silver, platinum as well as combinations of metals, e.g. brass and bronze, or other alloys. One aspect of the present invention is the use of nickel as the electroplating metal for the manufacture of rocket casings. As for the ends of the mandrel, one end may be substantially plated while the other end may either be unplated or plated to provide a small lip on that end of the casing product.

When carrying out the inventive method, coat the outer surface of the mandrel with a separating medium which facilitates the separation of the finished casing after electroforming is completed. One of the preferred separating materials, especially for the manufacture of rocket casings, is a wax. Other materials include grease, a silicon-containing grease, talc or mica. Also it is possible to teflon coat the outer surface of the mandrel. The use of a particular separation material is not critical.

Metals such as steel, nickel, aluminum or other metals, especially those which are not unduly heavy, may be used for constructing the mandrel. One advantage of the present invention is that light metals can be used and there is no need to employ special alloys. In the electroplating bath the mandrel acts as the cathode for the plating current.

In the manufacture of rocket casings it is preferred to apply an insulating material on top of separating material. The requisite insulation can best be achieved by using rubber, as already prescribed for rocket casing linings, which may be vulcanized in situ to ensure that the entire inner surface of the finished casings is fully and completely insulated. It is also possible, however, to perform the curing vulcanization just prior to or following removal of the electroformed casing from the mandrel.

Another important feature of the present invention is the step of applying a conductive metal material on to the outer surface of the insulating layer, e.g. the rubber insulator. Thus a silver nitrate solution can be sprayed on rubber surface to attain a flash film, conductive, silver surface. Silvering can also be achieved by utilizing very fine particles of silver incorporating in a vinyl lacquer using amyl acetate as the solvent. These are examples of available means for enhancing the conductivity of the surface of the insulating layer, the stripping material, or whatever coating is used in the particular casing production method.

The hollow mandrel with the thus prepared outer surface is positioned horizontally in a large plating bath or tank which for most purposes is long enough to accomodate the longest contemplated casing (approximately 120 or 180 feet) and wide enough to accommodate a 12 foot diameter casing or even diameters up to about 20 feet or greater.

The electroplating bath, for example, can contain nickel sulfamate as the major component and as a source of the nickel metal plated on to the outer prepared surface of the mandrel. Anode material in the electroplating bath can be supplied from fresh nickel, nickel metal sources or from reprocessed used nickel metal obtained from previously electroformed casings or tanks. In other words, the nickel metal can be recovered from used casings. It also will be understood that nickel salts may be employed, with the nickel anode bars, as metal sources.

For most purposes, the horizontal immersion of the mandrel in the electroplating will be at a depth sufficient to have from 50 to 95% of the outer surface of the mandrel submerged during its rotation. This will not only result in maximum plating for a given period of time, but it also ensures that portions of the mandrel will out of the solution. By operating in this manner, carbon fibers in the form of filament, normally in combination with an epoxy resin, are wound around the mandrel and become embedded to form a circumferential nickel-carbon fibers composite layer. Nickel with embedded carbon fibers provides an exceptionally strong, i.e. high tensile strength, casing that has the additional advantage of being considerably lighter than the steel casings now employed. And furthermore they are a single-pieced (i.e. monolithic) with seams and obviously not requiring the troublesome joints and gaskets essential to segmented casings. Steel casings have to be of special alloys and subjected to heat treating procedures to develop the desired strengths in the steel plates and welds.

DETAILED DESCRIPTION OF THE DRAWINGS AND THE INVENTION

The drawings illustrate apparatus that is useful in carrying out the preferred embodiment of the method of this invention, and illustrate as well as a partial cross-sectional view of a casing made in accordance with the practice thereof.

Figure 1:
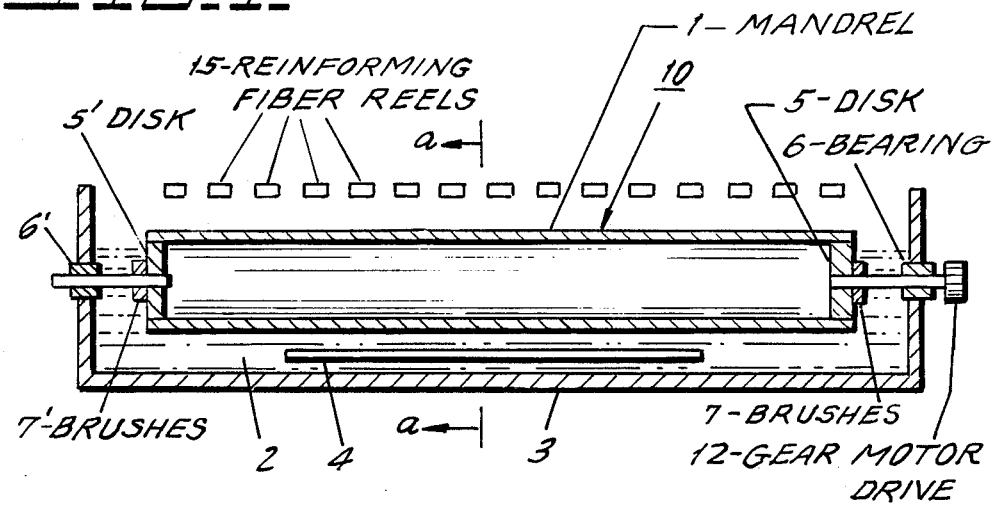
FIG. 1 is a longitudinally, cross-sectional view of the mandrel suspended in an electrolyte solution in a tank.
Figure 2:
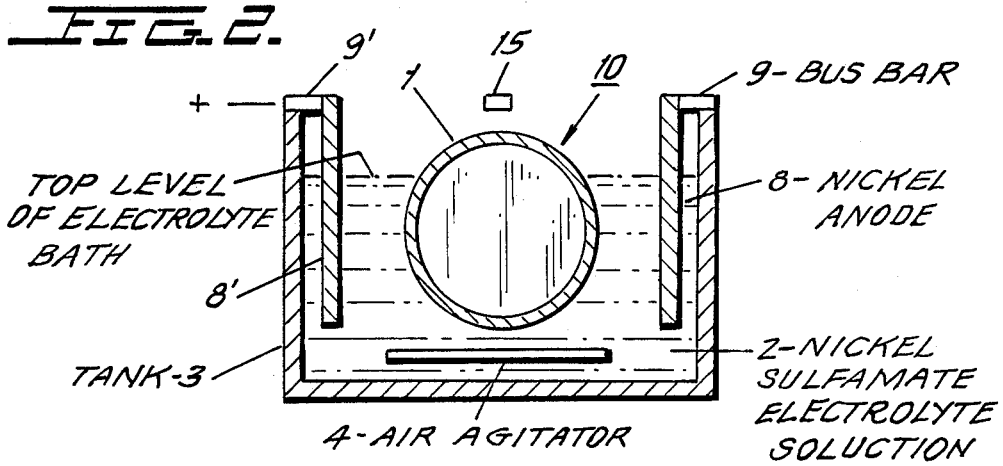
FIG. 2 is a partial vertical cross-sectional view taken through line a—a of FIG. 1.

FIGS. 1 and 2 show a hollow mandrel 11 suspended horizontally in an electrolyte solution or bath 2 in a plating tank 3. The bath is heated either by internal or external means (not shown) and agitated by an air agitator 4.

Mandrel 11 is sealed at each end with disks 5 and 5' which are provided with bearings or journals shafts 6 and 6' which are used to rotate mandrel 11 by means of gear motor drive 12. The bearings 6 and 6' are provided with brushes 7 and 7' for supplying low voltage direct current generator current from an electrical source (not shown) so that mandrel 11 acts as a cathode during the electroplating procedure.

A plurality of reels 15 are positioned above the exposed surface of mandrel 11 and are used for applying carbon fibers or other reinforcing filaments (not shown) to the surface of the mandrel while it is being metal plated with a metal such as nickel. As will be explained below, the reels 15 may be constructed that they move back and forth laterally for limited distances to ensure that a proper fiber-metal matrix or composite is developed without encountering undesirable void formation.

The partial vertical cross-sectional view of FIG. 2 further shows nickel anodes 8 and 8' connected by bus bars 9 and 9' to an electric current source (not shown).

Figure 3:
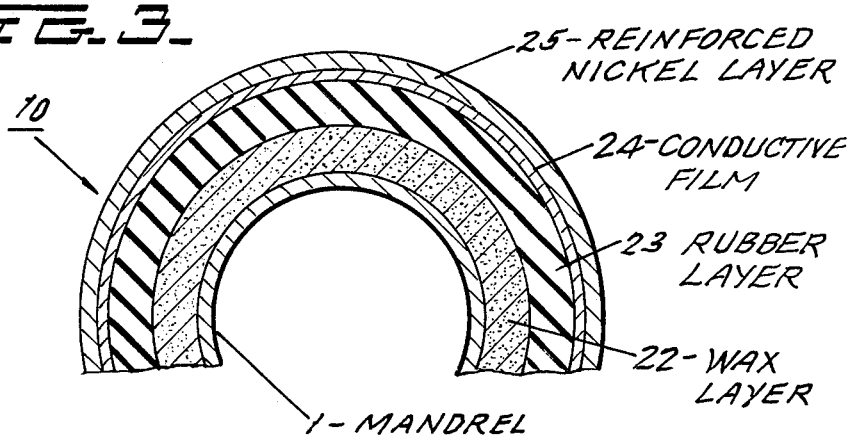
FIG. 3 is a partial cross-sectional view of the mandrel through an inner wall portion and illustrating the layers formed on said mandrel.

FIG. 3 a partial cross-sectional view of mandrel 11 following the metal electrodeposition operations, shows an inner wall portion 21 of mandrel 11, the separation material or wax layer 22, the insulation or rubber layer 23, the conductive metal or silver film layer 24, and the outer reinforced metal or nickel layer 25 (the reinforced fibers not being shown). The mandrel plus all of the above layer is labelled 10 in all of the drawings.

Although FIG. 3 shows only one electroformed metal layer, it will be understood that a plurality of layers may be deposited depending upon the ultimate use of the cylindrical casings of this invention. Thus, a nickel layer or nickel and then copper layers may be laid down, prior to electrodepositing the reinforced metal layer containing the reinforcing fibers or filaments, e.g. nickel metal containing carbon filaments to form the outer layer. It might also be desirable to coat the deposited reinforced metal layer with the same or other which are not reinforced. It will be further understood that the thickness of the various layers on the mandrel (as described below) may vary depending on the material employed as well as on the intended use of the cylindrical casing products.

As previously discussed, the hollow mandrel may be made of steel, nickel, nickel-steel, aluminum, reinforced plastics, segmented engineering plastics, and the like. The disks which seal off the ends of the mandrel, which prevents undesirable metal deposition on the internal portions of the mandrel, will generally be constructed of the same metal or metal alloy used for the mandrel. It will be readily understood that the mandrel must be slightly smaller in length and diameter dimensions than the dimensions desired for the final cylindrical casings. Of course, these dimensions will depend upon the number and depth of the layers coated or deposited on the outer surface. It will be noted that the type of mandrels employed as well as the tank or vessel used to carry out the deposition do not constitute critical features of the present invention.

The preparation of the outer surface of the hollow mandrel does, however, constitute important aspects of the invention. A separation material is coated with a conductive material. Although the use of wax is preferred as the separation material for the purpose of preparing rocket casings, other materials can be employed such as low temperature metals, soluble salts, and liquefiable solids. Some of these other materials are discussed above and include grease, lead, silicon, etc. The depth or thickness of the separation material may range from about 0.2 to 5.0 cm, but preferably from 0.3 to 0.6 cm. It will be understood that only a thickness necessary to effect separation of the mandrel from the finished cylindrical casings need be employed.

A layer of an insulating material is then added on top of the separation material. For rocket casings rubber is the preferred insulating material, and it is generally employed in depths or thicknesses ranging from 0.6 to 6.0 cm. It has been and will probably be used in varying controlled thicknesses of approximately about 6 to 60 cm. Other materials that may be utilized to achieve the desired insulation include, but are not limited to, assorted man made compounds ranging from neoprene rubber and polyurethane compounds to asbestos-filled similar materials and the like. Commercially available room temperature vulcanizing (RTV) rubbers and asbestos-filled nitrile butyl rubbers are preferred.

Since natural or synthetic rubber or other useful insulating materials are non-conductive or will have limited conductivity, it is necessary to coat or deposit a thin conductive layer on the exposed surface of the insulating layer. In general, a thin layer or film of silver metal can be flash coated, spray deposited or otherwise applied to the surface of the insulating material.

Following the application of the thin layer or film of conductive metal the thus prepared mandrel form is placed in an electroplating bath. Neither the means of horizontally placing or ultimate removal of the mandrel in the electroplating bath constitute inventive features, such procedures and apparatus, including the necessary hoists, are known to those of ordinary skill in this art.

As noted the ends of the hollow mandrel are sealed off with disks or plugs and provided with means for suspending the mandrel in the electrolyte bath solution. Rotation is carried out by conventional means, and the linear velocity of rotation will range from about 0.05 to 2.0 cm per second, and preferably from 0.15 to 0.60 cm per second, as required under conventional electroplating procedures used to develop a very high tensile strength nickel matrix.

The temperature of the plating bath will vary from 35° to 85° C. with current density ranging from 5 to 40 amps/ft$^2$. Conventional plating bath formulations may be employed. As an example, a commercial plating bath solution, containing nickel sulfamate as well as typical hardening additives, utilized in conjunction with commercial grade nickel anodes will provide the proper grade of nickel metal deposit. A typical bath solution is set forth below and comes from U.S. Pat. No. 3,505,177 (Col. 5, which is incorporated by reference):

| Component | Conc: Ounces per Gallon of Distilled water |
|---|---|
| Nickel sulfamate | 40–60 |
| Nickel chloride | 0.2–0.6 |
| Boric acid | 4–6 |
| Saccharin | 0.001–0.02 |
| Sodium lauryl sulfate | 0.05 |

The precise nature of the electrolyte is not an essential feature of the invention, since the electrodeposition of metals such as nickel on mandrels is known in the art. See, for example, the following U.S. Pat. Nos.:

2,137,806
2,613,178
3,112,895
3,255,976
3,763,001
3,947,348
4,118,262
4,326,928
4,511,438

The tanks or vessels used to contain the electrolyte baths may be constructed of stainless steel, fiber glass reinforced polyesters or polycarbonates. For purposes of convenience when relatively long electroplating tanks are employed, a portion of the tank may be positioned below the surface of the ground.

The invention will be more fully understood by reference to the following embodiment.

EXAMPLE

A stainless steel hollow mandrel, 115 feet long and 11.8 feet in outside diameter, is initially coated on the outer surface with a layer of commercial wax sheets to a depth of about 1 cm. Next a layer of asbestos-filled nitrile butyl rubber is placed on top of the wax. This insulation layer will have a thickness of about 8 cm, and will be unified or vulcanized by applying heat and pressure, if necessary. A thin film of metallic is then flashed on top of the rubber layer to achieve a conductive surface.

The hollow mandrel, which is sealed at its end with stainless steel or other types of disks that are provided with bearings for aid in supporting the mandrel and for permitting rotation.

The thus prepared hollow mandrel is then placed on to trunions for supporting the mandrel in a steel plating tank 120 feet long, 15 feet high, and 16 feet wide. The tank which is provided with nickel metal anode baskets is filled to a depth of about 12 feet with a commercial nickel sulfamate plating solution, as described above.

While the electrolyte solution is maintained at a temperature of about 50° C., the mandrel is rotated at a linear velocity 0.5 foot per second (approximately 1 rph), and a current density of 20 amps/ft$^2$ is applied. Plating of nickel metal commences and then carbon fibers are fed to the nickel surface from a multiplicity of reels positioned directly above the exposed surface of the rotating mandrel. The continuous carbon (graphite) fiber filaments unwound from reels have a diameter of from 3 to 5 microns in diameter and tensile strengths of up to 400,000 psi.

The nickel-carbon fiber matrix will be about 1 cm in thickness, and in general the matrix will have 5 overlaps of carbon filaments substantially without voids. The latter is important, since areas void of nickel metal which might develop around or beneath a carbon filament would create a highly disadvantageous weakness. The problem is effectively eliminated by having each of the multiple reels move horizontally above the exposed mandrel surface at a rate of about 2 inches over a period of 16 turns of the mandrel, the reels being placed at 6 inches apart, while the filaments are fed to surface of the mandrel at a pitch of about ⅛ inch. This procedure provides full and complete nickel metal matrix coverage of each turn of filamend as the reel frame starts its return trip.

The resulting carbon-fiber reinforced, nickel electrodeposited casing is one piece, seamless, no weld lines and no segment seals, and at least 20% lighter than the segmented rocket casings that have been previously employed. Once the wax has been melted by a heat treatment which vulcanizes or completes vulcanization of the rubber insulation joints, the casing with its built-in rubber lining is ready to be provided with conventional front and bottom ends and filled with rocket fuel. The light weight as well as the high tensile strength results from the incorporation of the carbon fibers into the nickel to form a unique matrix or composite.

Although the invention has been described above and illustrated particularly with respect to the manufacture of rocket casings, it will be appreciated that casings of various dimensions in the relatively large size range for many different uses may be formed by utilizing the method of the present invention. It will be further understood that for many purposes a rubber layer or lining is not necessary and may be eliminated. In such instances and provided the outer surface of the mandrel is electrically conductive, the thin or flash coating of the conductive metal may also be eliminated. In such cases, the mandrel must be of a removal, such as segmented, design or passivated before plating.

By utilizing the method of the present invention it is possible to provide large, leak-proof, tanks for storing toxic wastes. Such tanks or cylinders, containing the toxic wastes, can then be safely stored underground. An example of such tanks or cylinders would be approximately 12 feet in diameter and 30 feet long. Again, the thickness of the nickel metal-carbon matrix wall will be about ⅛ of an inch, although this can vary. For certain toxic wastes a special liner such as metal lead may be employed. When dealing with radioactive wastes not only will liners such as lead be employed but for some purposes two concentric cylinders may be utilized, the inner cylinder having a smaller diameter so that a space will exist between the concentric cylinders which may be filled with water or other shielding fluid.

Thus, the invention is not limited to the specific embodiment described and is therefore subject to various changes and modifications without departing from the broader aspects of the invention.

What is claimed is:

1. A method for the electrolytic production of a filament-wound, reinforced metal casing having an internally attached insulation layer, which comprises the following sequential steps:

(a) coating the outer surface of a hollow mandrel with a layer of a separating material, said mandrel having dimensions slightly smaller than length and diameter dimensions of the desired filament-wound, reinforced metal casing;

(b) coating the layer of separating material with a layer of a non-conductive insulating material;

(c) coating the layer of insulating material with a thin film of electrolytically conductive material;

(d) immersing the thus prepared mandrel in an electroplating bath provided with means for rotating said mandrel at controlled speeds, and wherein said electroplating bath contains a metal salt electrolyte solution at a depth whereby not over 25% of the outer surface of said mandrel is not immersed and remains exposed;

(e) electrodepositing metal on the thus prepared outer surface mandrel while the mandrel is being rotated through said electrolyte solution;

(f) winding reinforcement fibers on the exposed outer surface of the mandrel as the mandrel is being rotated and while electrodepositing metal from said electrolyte on to the outer surface of the mandrel to form a reinforced metal casing having an internal insulation layer attached thereto; and (g) separating said filament-wound reinforced metal casing from the mandrel by applying heat to said mandrel whereby the separating material on the outer surface of the mandrel melts thereby permitting the reinforced metal casing with the internally attached insulating layer to be separated from the mandrel.

2. The method of claim 1 wherein the mandrel is constructed from a material selected from the group consisting of stainless steel, nickel, aluminum, reinforced polyester epoxy, and engineering plastics.

3. The method of claim 1 wherein the separating material is selected from the group consisting of wax, silicon, grease, low melting temperature metals, selectively soluble salts, and chemically decomposable plastics.

4. The method of claim 3 wherein the separating material is wax.

5. The method of claim 1 wherein the insulating material is selected from the group consisting of natural synthetic rubber, plastic composition shields, teflon, lead, and refractory materials having a flexible matrix.

6. The method of claim 5 wherein the insulating material is natural or synthetic rubber.

7. The method of claim 1 wherein the thin conductive film is composed of a material selected from the group consisting of silver, gold, copper, and electrolytically conductive material.

8. The method of claim 1 wherein the metal being electrodeposited on the mandrel is selected from the group consisting of nickel, chromium, copper, brass, bronze, and lead.

9. The method of claim 1 wherein said reinforcing filaments are selected from the group consisting of carbon fibers, glass fibers, boron fibers, and high modulus organic polymer filaments.

10. A method for the electrolytic production of a filament-wound reinforced nickel metal casing having an internally attached insulation layer, said casing having a long length and a large diameter which comprises the following sequential steps:

(a) coating the outer surface of a hollow mandrel with a separating material, said mandrel having dimensions slightly smaller than the length and diameter of the desired filament-wound reinforced nickel metal casing, to form a layer of separating material;

(b) coating the layer of separating material with a layer of a non-conductive insulating material;

(c) coating the layer of insulating material with a thin film of conductive metal;

(d) positioning the thus prepared mandrel horizontally in an electroplating bath provided with means for longitudinally rotating said mandrel at controlled speeds; and wherein said electroplating bath contains a nickel salt electrolyte solution at a depth whereby about 10 to 25% of the outer surface of the mandrel is not immersed but exposed;

(e) electrodepositing nickel metal on the thus prepared outer surface of the mandrel while the mandrel is being rotated through said electrolyte solution;

(f) winding carbon fiber filaments on the exposed outer surface of the mandrel as the mandrel is being rotated and while electrodepositing nickel from said electrolyte on to the outer surface of the mandrel to form a reinforced nickel metal casing having an internal insulation layer attached thereto; and (g) separating said reinforced nickel metal casing from the mandrel by applying heat to said mandrel whereby the layer of separating material melts thereby permitting the reinforced nickel metal casing with the internally attached insulating layer to be separated from the mandrel.

11. The method of claim 10 wherein said mandrel is made of steel.

12. The method of claim 10 wherein the separating material is wax.

13. The method of claim 10 wherein the insulating material is rubber.

14. The method of claim 10 wherein the thin film of conductive metal is silver film.

15. A product formed by the method of claim 1.

16. A product formed by the method of claim 10.

* * * * *